US007152372B2

(12) United States Patent
Cheng

(10) Patent No.: US 7,152,372 B2
(45) Date of Patent: Dec. 26, 2006

(54) GATE

(76) Inventor: Shu-Chen Cheng, 10F, No. 29-5, Sec. 2, Chung Cheng E. Rd., Tamshui Chen, Taipei Hsien (TW)

( * ) Notice: Subject to any disclaimer, the term of this patent is extended or adjusted under 35 U.S.C. 154(b) by 114 days.

(21) Appl. No.: 11/080,411

(22) Filed: Mar. 16, 2005

(65) Prior Publication Data

US 2006/0207180 A1 Sep. 21, 2006

(51) Int. Cl.
*E05C 21/02* (2006.01)

(52) U.S. Cl. ..... 49/465; 49/55; 49/57

(58) Field of Classification Search ..... 49/463, 49/465, 50, 57, 55

See application file for complete search history.

(56) References Cited

U.S. PATENT DOCUMENTS

| | | | | |
|---|---|---|---|---|
| 6,112,461 | A * | 9/2000 | Cheng | 49/55 |
| 6,446,395 | B1 * | 9/2002 | Rogers | 49/463 |
| 6,536,163 | B1 * | 3/2003 | Monahan et al. | 49/465 |
| 2006/0185253 | A1 * | 8/2006 | Marsden et al. | 49/465 |

* cited by examiner

*Primary Examiner*—Jerry Redman
(74) *Attorney, Agent, or Firm*—Bacon & Thomas, PLLC

(57) ABSTRACT

A gate has a frame, a gate door, a latch and a latch seat. The gate door is pivotally mounted in the frame. The latch is attached to a top corner of the gate door. The latch seat is attached to a top inner corner of the frame. The latch seat and the latch engage each other to latch the gate door to the frame. Unlatching the gate door requires multiple actions so children or pets are not able to open the gate. The safety of children is assured, and pets will not ruin objects isolated by the gate.

2 Claims, 12 Drawing Sheets

GATE

BACKGROUND OF THE INVENTION

1. Field of the Invention

The present invention relates to a gate, and more particularly to a gate that keeps children or pets out of restricted areas that may cause injury to children or allow pets to ruin objects in the area.

2. Description of Related Art

Virtually all children and young pets are very active and curious so parents and pet owners have to be vigilant and pay nearly constant attention to keep children from being injured or pets from ruining furniture or household objects.

With reference to FIG. 12, a conventional gate comprises a frame (70), a gate door (71) and a latch (72). The frame (70) is U-shaped and has four outer corners, two proximal inner corners, four holes (701) and four mounting bolts (73). The holes (701) are formed respectively at the outer corners. Each mounting bolt (73) has a threaded shaft, a proximal end, a distal end and a threaded collar (731). The proximal end of the bolt (73) extends into the hole (701) of the frame (70). The collar (731) is against the frame (70). The rear end of the bolt (73) is against a wall to install the frame (70).

The gate door (71) is mounted pivotally on the two proximal inner corners of the frame (70) and has a top distal corner.

The latch (72) is mounted on the top distal corner of the gate door (71) and latches the gate door (71) to the gate post (70).

The frame (70) can be mounted in any entryway, such as a kitchen doorway, a living room archway, the top or bottom of a staircase or the like.

However, the latch (72) cannot lock the gate door (71) closed in the frame (70), and children or pets can unlatch and open the gate door (71) without any trouble and get into the restricted area.

To overcome the shortcomings, the present invention provides a gate to obviate or mitigate the aforementioned problems.

SUMMARY OF THE INVENTION

The primary objective of the present invention is to provide a gate that keep children or pets from getting into specific areas.

The gate has a frame, a gate door, a latch and a latch seat. The gate door is mounted pivotally in the frame. The latch is mounted on a top corner of the gate door. The latch seat is mounted on a top inner corner of the frame. The latch engages the latch seat to latch the gate door in the frame. The gate door is not easy to unlatch so children or pets are not able to get into a restricted area.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
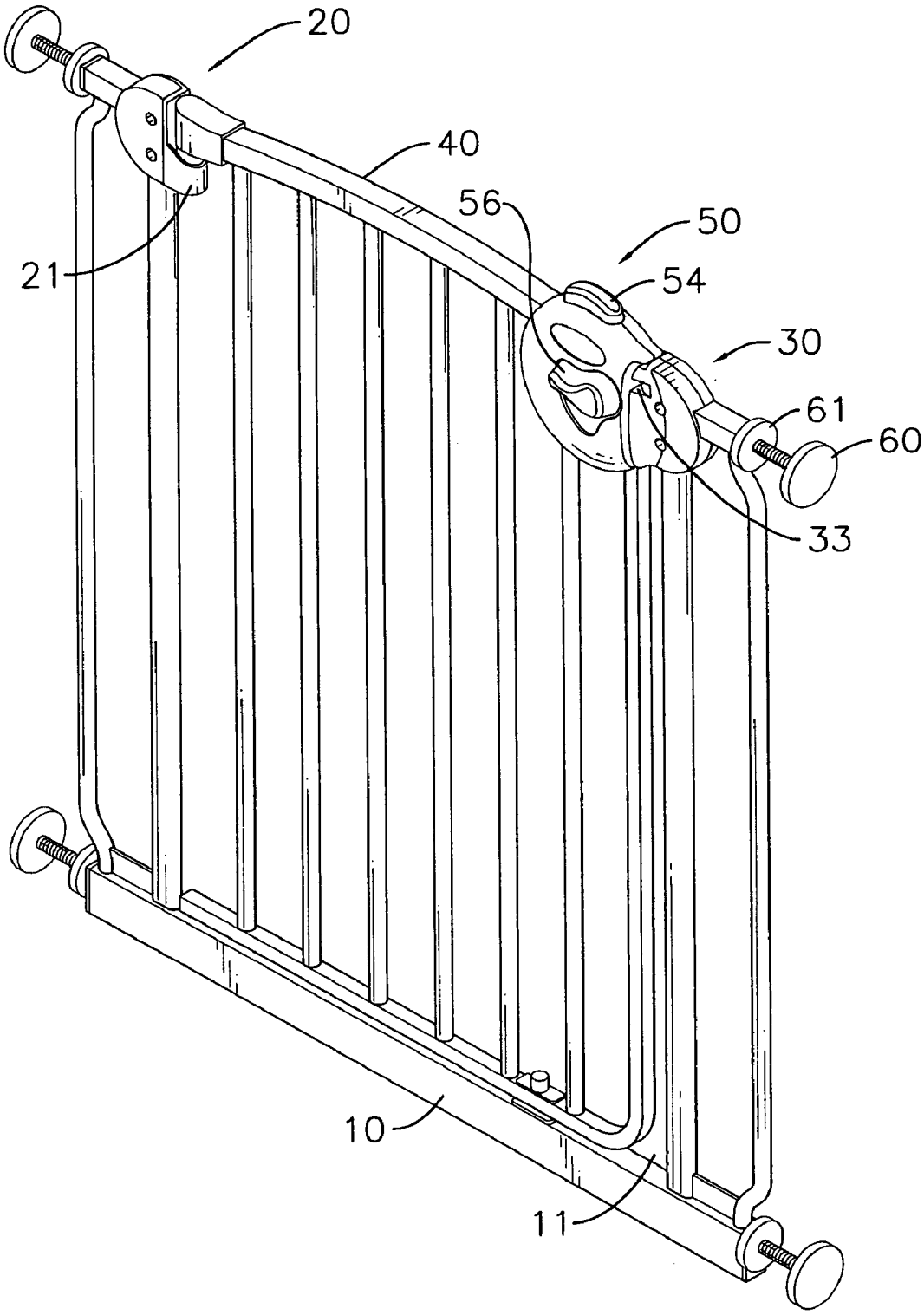
FIG. 1 is a perspective view of a gate in accordance with the present invention.
Figure 2:
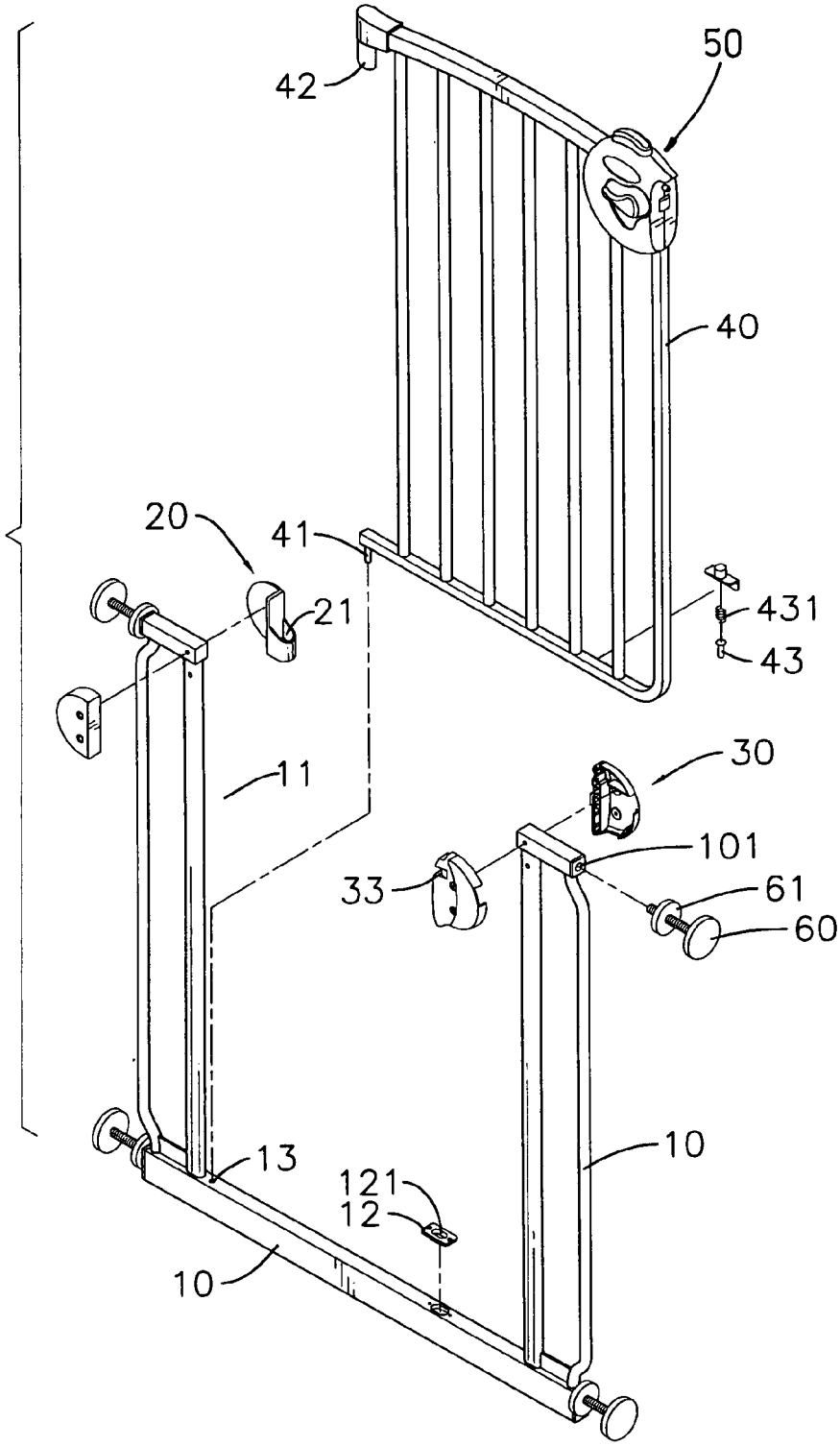
FIG. 2 is an exploded perspective view of the gate in FIG. 1.
Figure 4:
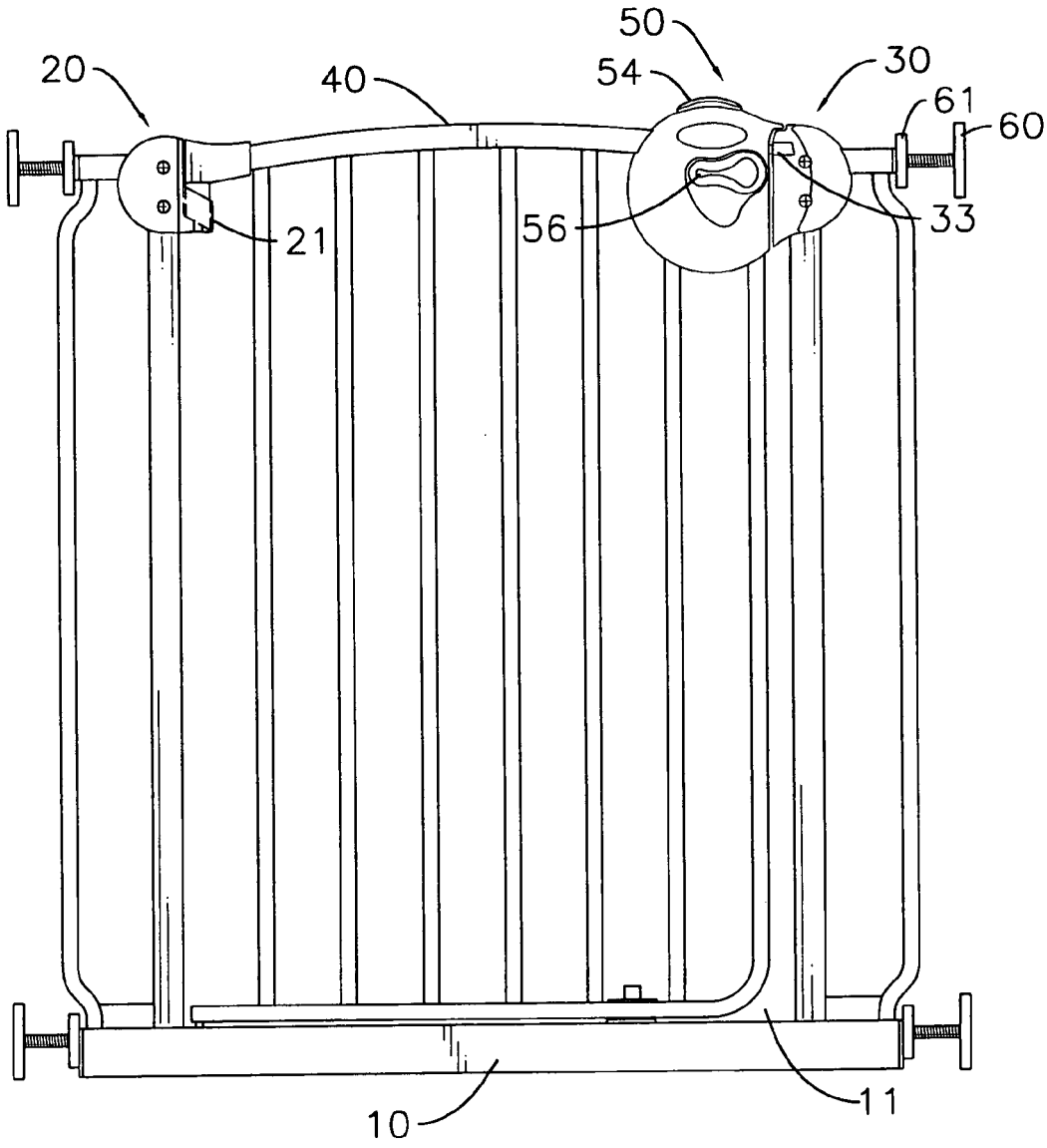
FIG. 4 is a front view of the gate in FIG. 1.

With reference to FIGS. 1, 2 and 4, a gate in accordance with the present invention comprises a frame (10), a hinge pin seat (20), a latch seat (30), a gate door (40), a latch (50) and four mounting bolts (60).

The frame (10) has four outer corners, an opening (11), a top inner proximal corner and a top inner distal corner. Each outer corner has a threaded hole (101). The opening (11) is formed in the frame (10) and has a bottom edge, a pivot hole (13) and a locking plate (12). The pivot hole (13) is formed in the bottom edge of the opening (11). The locking plate (12) is mounted on the bottom edge of the opening (11) and has a locking bolt hole (121) formed in the locking plate (12).

The hinge pin seat (20) is attached to the top inner proximal corner of the frame (10) and has a barrel (21). The barrel (21) is formed in the hinge pin seat (20) and has an inclined inner end.

Figure 6:
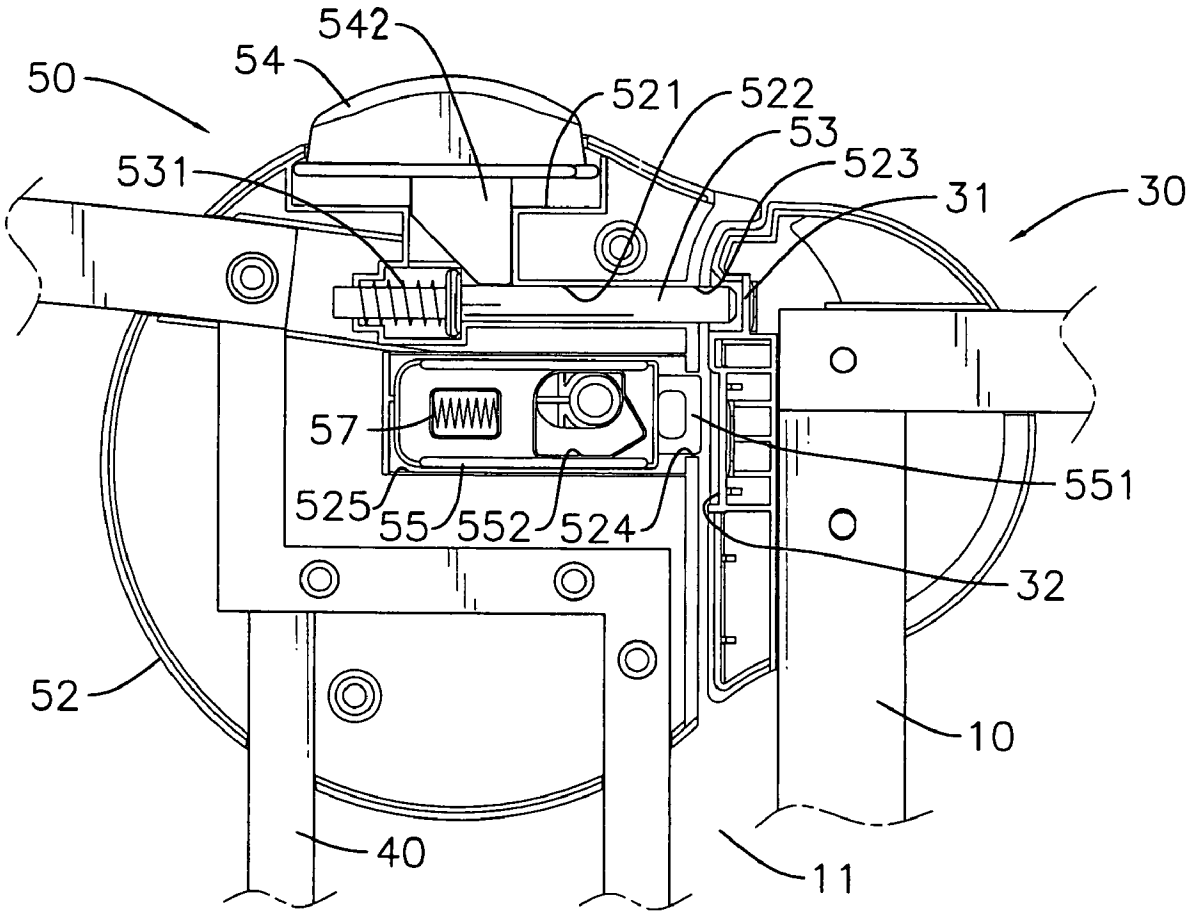
FIG. 6 is a front internal view of the latch in FIG. 3 in a latched position.

With further reference to FIG. 6, the latch seat (30) is attached to the top inner distal corner of the frame (10) and has two side surfaces, a latch pin recess (31), a latch bolt recess (32) and two inclined notches (33). The latch pin recess (31) and latch bolt recess (32) are formed horizontally in the latch seat (30). The inclined notches (33) are formed respectively on side surfaces of the latch seat (30) and communicate with the latch pin recess (31).

Figure 10:
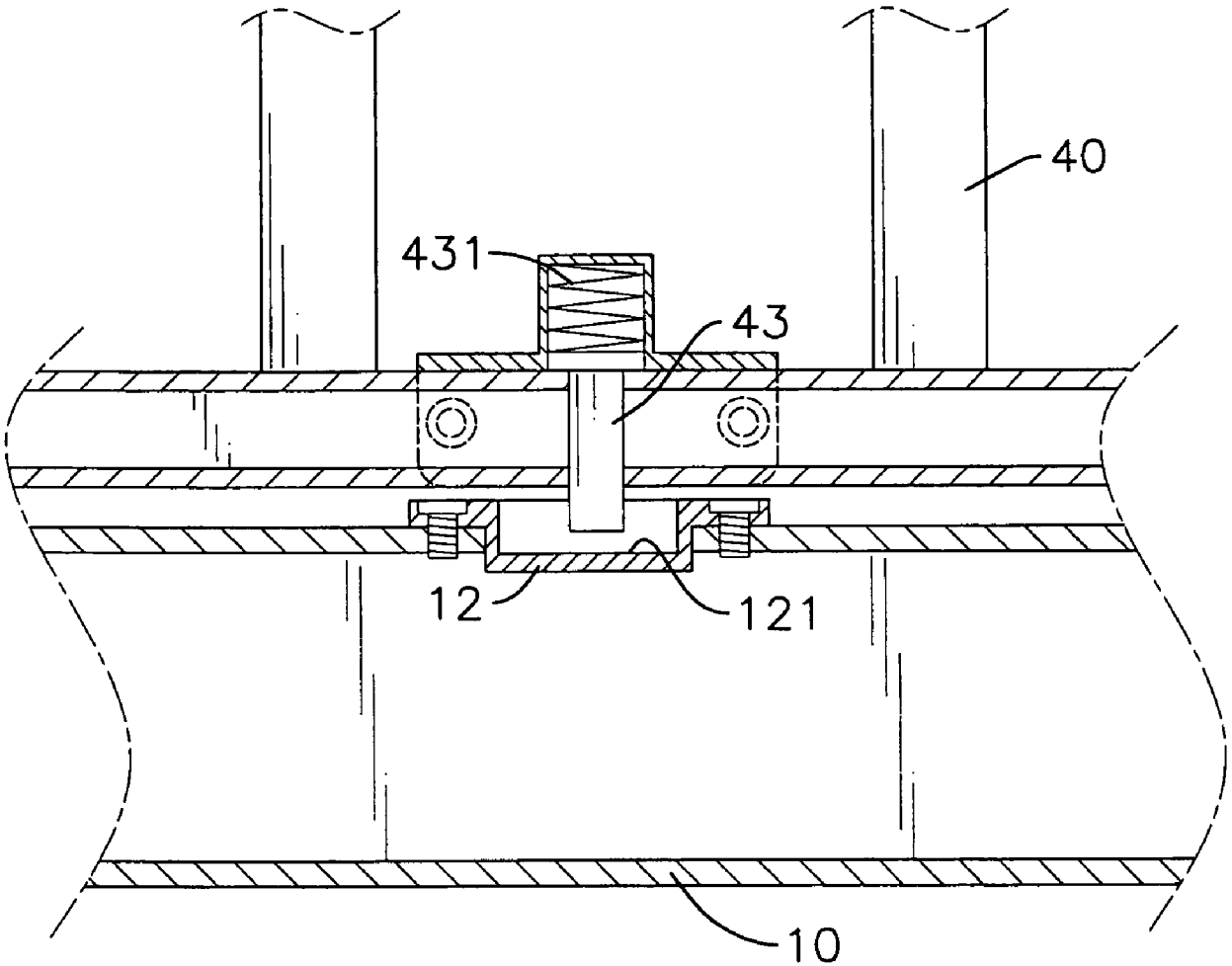
FIG. 10 is an enlarged operational cross sectional front view of a locking bolt in FIG. 5 in a locked position.

The gate door (40) has a top proximal corner, a top distal corner, a bottom, a bottom pivot pin (41), a top pivot pin (42), a locking bolt seat, a spring (431) and a locking bolt (43). The bottom pivot pin (41) protrudes down from the bottom of the gate door (40) and is mounted pivotally and slidably in the pivot hole (13) in the frame (10). The top pivot pin (42) is attached to the top proximal corner of the gate door (40), has an inclined bottom surface and is rotatably mounted in the barrel (21) in the hinge pin seat (20). The locking bolt seat is mounted on the bottom of the gate door (40). The locking bolt (43) and the spring (431) are mounted in the locking bolt seat. With reference to FIG. 10, the locking bolt (43) is held in the locking bolt hole (121) of the frame (10).

Figure 3:
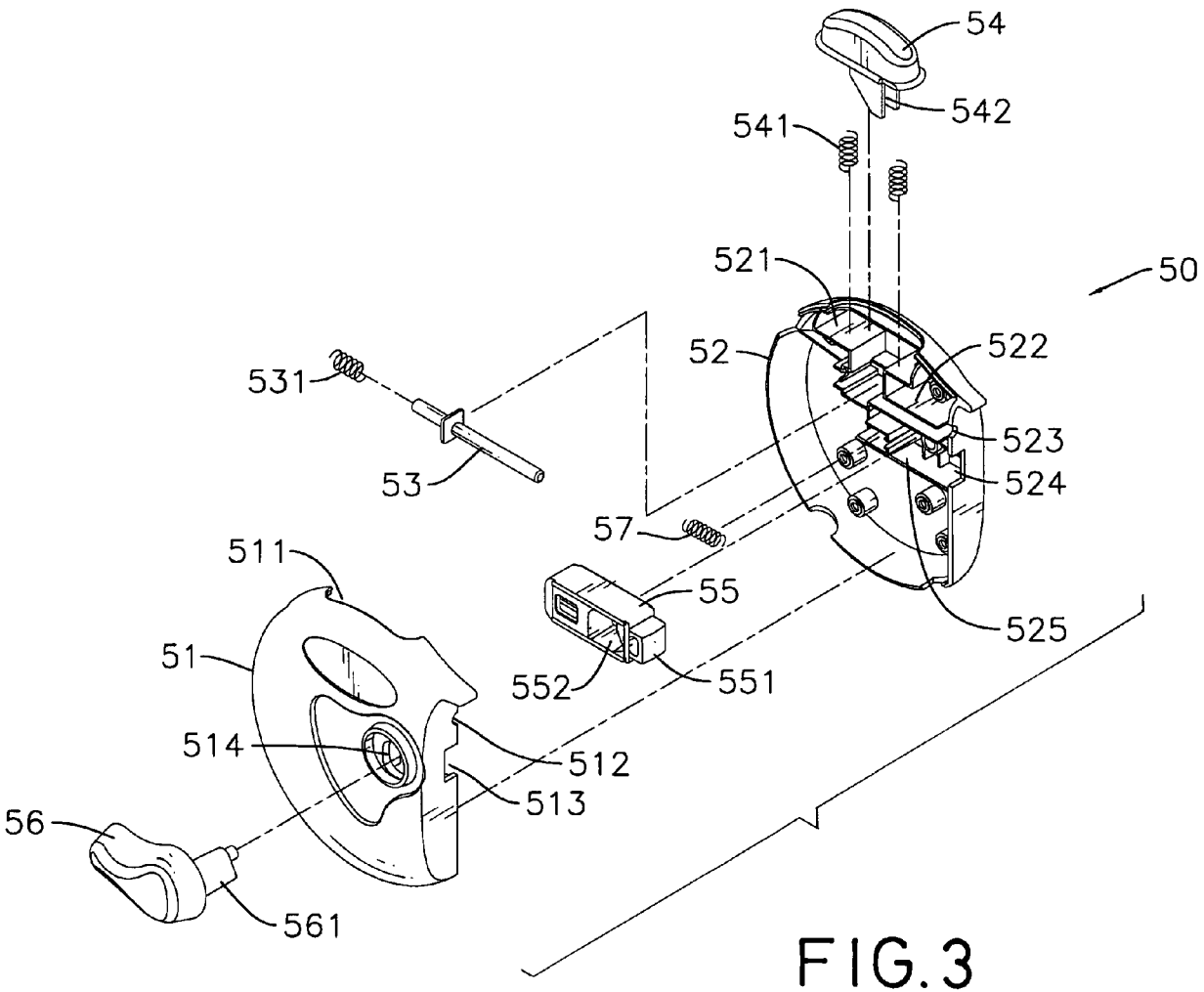
FIG. 3 is an enlarged exploded perspective view of the a latch in FIG. 1.

With reference to FIG. 3, the latch (50) is attached to the top distal corner of the gate door (40) and has a front casing (51), a rear casing (52), a latch block (55), a latch pin (53), a knob (56) and a release button (54).

The front casing (51) has a top, a front surface, a front end, a button recess (511), a latch pin cutout (512), a latch bolt cutout (513) and a through hole (514). The button recess (511) is formed in the top of the front casing (51). The latch pin cutout (512) and the latch bolt cutout (513) are formed in the front end of the front casing (51). The through hole (514) is formed through the front surface of the front casing (51).

The rear casing (52) is attached to the front casing (51) and has a top, a rear surface, a front end, a button recess (521), a latch pin recess (522), a latch block recess (525), a latch pin cutout (523) and a latch bolt cutout (524). The button recess (521) is formed in the top of the rear casing (52) and mates with the button recess (511) in the front casing (51) to form a button hole. The latch pin recess (522) and the latch block recess (525) are formed horizontally inside the rear casing (52). The latch pin cutout (523) and the latch bolt cutout (524) are formed in the front end of the rear casing (52). The latch pin cutout (523) communicates with the latch pin recess (522) and mates with the latch pin cutout (512) in the front casing (51) to form a latch pin hole. The latch bolt cutout (524) communicates with the latch block recess (525) and mates with the latch bolt cutout (513) in the front casing (51) to form a latch bolt hole.

The latch block (55) is mounted slidably in the latch block recess (525) in the rear casing (52) and has a distal end, a side, a latch bolt (551), an eccentric hole (552) and a spring (57). The latch bolt (551) is formed on and protrudes from the distal end of the latch block (55), extends through the latch bolt hole in the latch (50) and engages the latch bolt recess (32) in the latch seat (30). The eccentric hole (552) is formed through the side of the latch block (55).

The spring (57) is mounted between the latch block (55) and the rear casing (52) and has a front end and a rear end. The front end of the spring (57) presses against the side of the rear casing (52). The rear end of the spring (57) presses against the latch block (55) to disengage the latch bolt (551) from the latch bolt recess (32).

The latch pin (53) is mounted in the latch pin recess (522) in the rear casing (53) and has a front end, a rear end and a spring (531). The front end of the latch pin (53) protrudes through the latch pin hole in the latch (50) and engages the latch pin recess (31) in the latch seat (30). The spring (531) is mounted around the rear end of the latch pin (53) and presses against the rear end of the latch pin (53) and the latch pin recess (522) to make the front end protrude through the latch pin hole.

Figure 7:
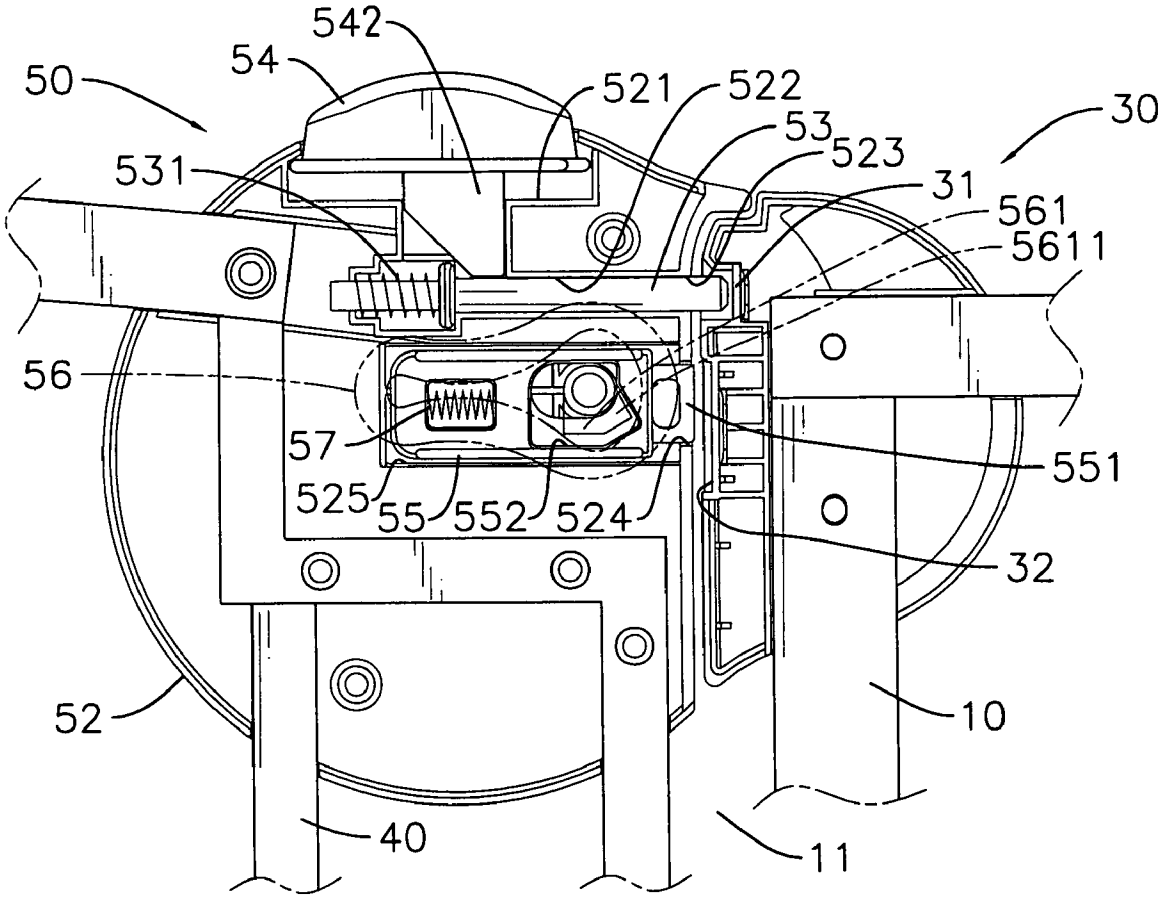
FIG. 7 is a front internal view of the latch in FIG. 6.
Figure 9:
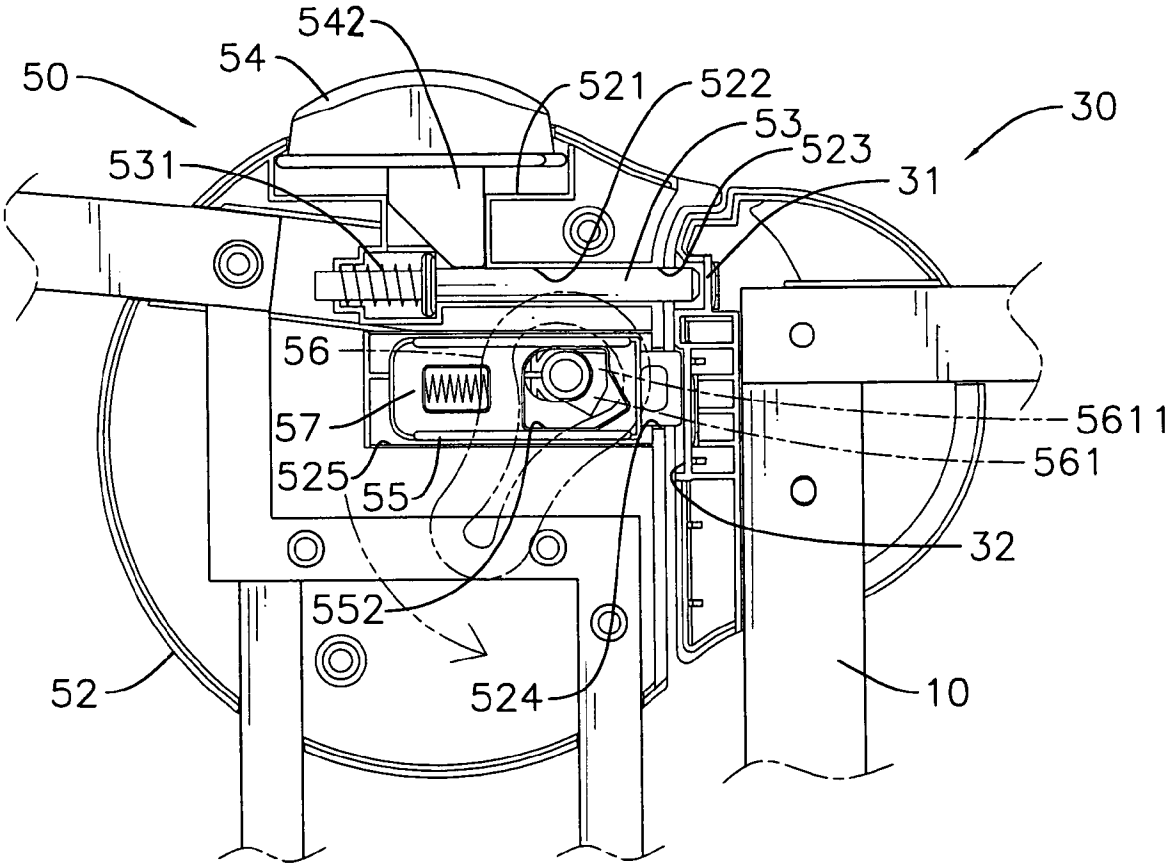
FIG. 9 is an operational front internal view of the latch in FIG. 3 locked in a latched position.

The knob (56) has an inside surface and an eccentric shaft (561). With further reference to FIG. 7, the eccentric shaft (561) is formed on and protrudes from the inside surface of the knob (56), extends through the through hole (514) in the front casing (51), engages the eccentric hole (552) in the latch block (55) and has an eccentric edge (5611). With further reference to FIG. 9, rotating the knob (56) counter-clockwise causes the eccentric edge (5611) of the eccentric shaft (561) to press against the eccentric hole (552) in the latch block (55) and push the latch bolt (551) through the latch bolt cutout (524). Continuing to rotate the knob (56) causes the eccentric edge (5611) to lock in place and hold the latch bolt (551) in the latch bolt recess (32) in the latch seat (30). Rotating the knob (56) clockwise releases the eccentric edge (5611) from the eccentric hole (552), and the spring (57) retracts the latch bolt (551) from the latch bolt recess (32) in the latch seat (30).

Figure 8:
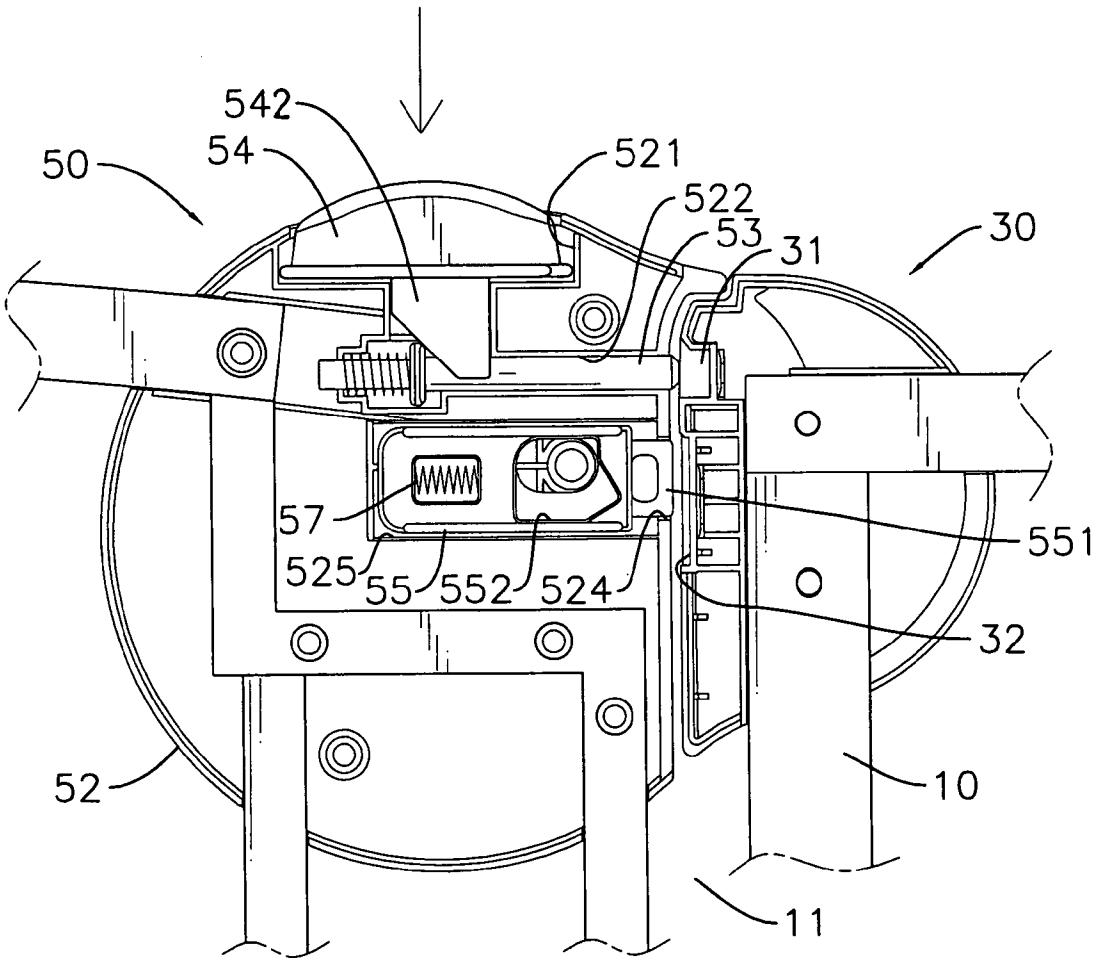
FIG. 8 is an operational front internal view of the latch in FIG. 3 unlatched.

The release button (54) is mounted in the button hole in the latch (50) and has a bottom, two actuating legs (542) and multiple springs (541). The actuating legs (542) are formed on and protrude down from the bottom of the release button (54) in parallel on opposite sides of the latch pin (53) and have respectively an inclined edge. With further reference to FIG. 8, the inclined edge retracts the latch pin (53) from the latch pin recess (31) in the latch seat (30) when the release button (54) is pressed down. The springs (541) press against the bottom of the release button (54) and press the release button (54) up in the button hole in the latch (50) when the release button (54) is released.

The mounting bolts (60) are mounted respectively in the threaded holes (101) in the outer corners of the frame (10), and each mounting bolt (60) has a distal end, a locking nut (61), a threaded shaft and a head. The locking nut (61) has a threaded central hole. The threaded shaft screws through the locking nut (61) and into the threaded hole (101) in a corresponding outer corner of the frame (10). The head is formed on the distal end of the mounting bolt (60). The mounting bolts (60) are screwed out of the threaded holes (101) until the heads press against structural members such as walls, banister posts, doorframes or the like to hold the gate in place. The locking nuts (61) are tightened respectively against the outer corners to keep the mounting bolts (60) from loosening.

Figure 5:
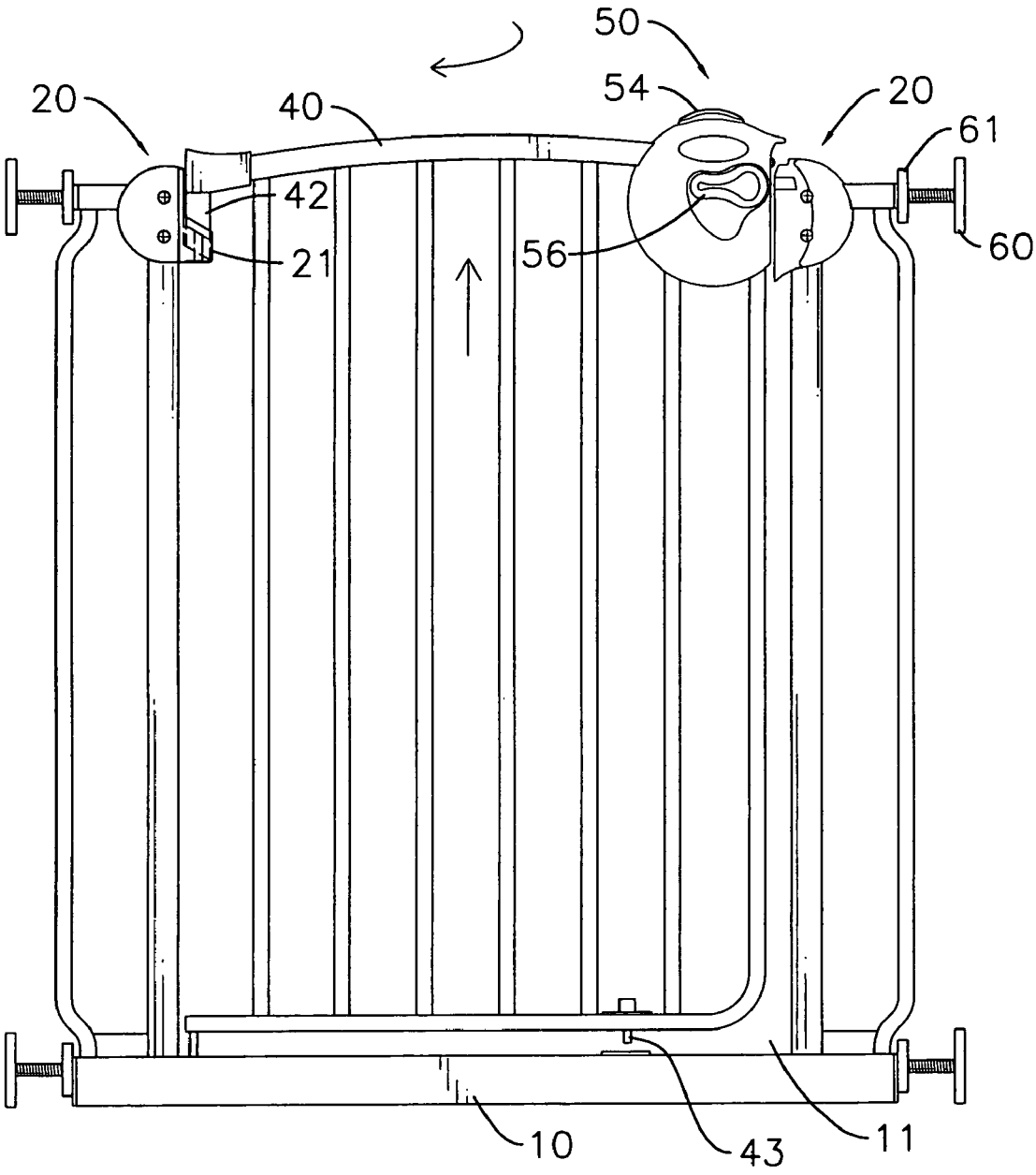
FIG. 5 is an operational front view of the gate in FIG. 4.
Figure 11:
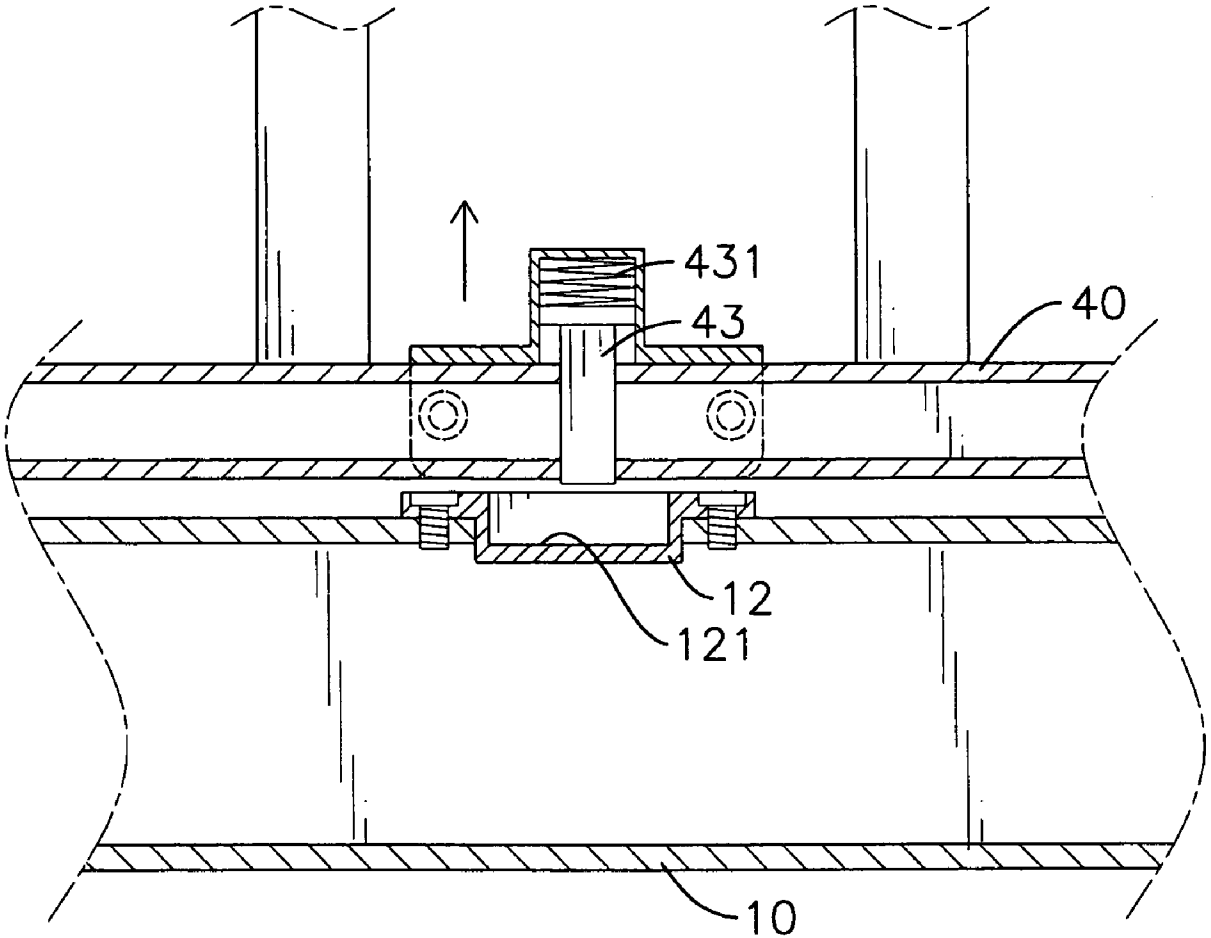
FIG. 11 is an enlarged operational cross sectional front view of the locking bolt in FIG. 5 retracted when the gate closes.
Figure 12:
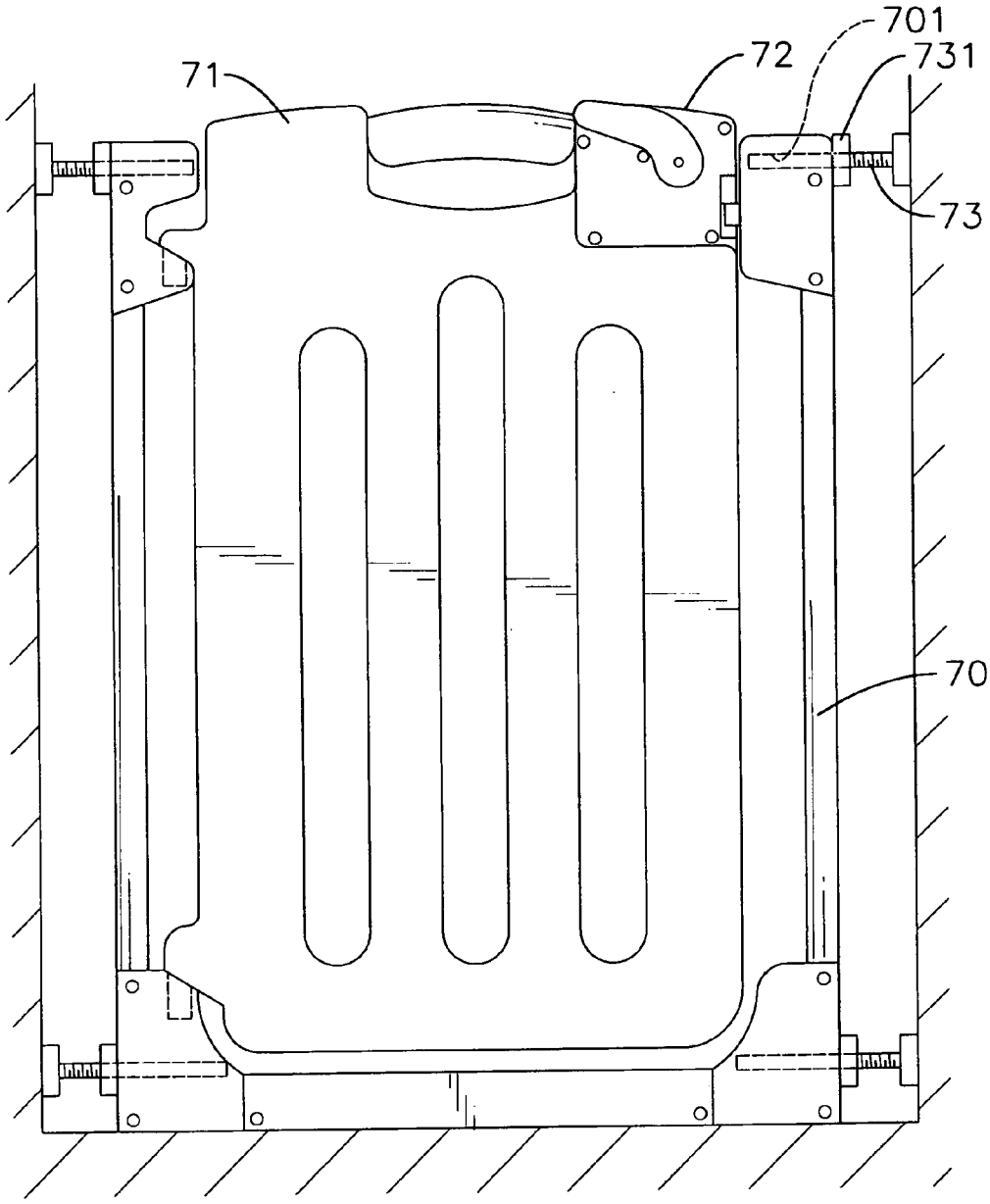
FIG.12 PRIOR ART
FIG. 12 is a perspective view of a conventional gate in accordance with the prior art.

Three distinct actions are required to open the gate, and two of the actions must be performed simultaneously. The three essential actions consist of turning the knob (56), pressing the release button (54) and lifting the gate door (40). As previously described, turning the knob (56) and pressing the release button (54) retract the latch bolt (551) and the latch pin (53) respectively from the latch bolt recess (32) and latch pin recess (31) in the latch seat (30). With further reference to FIGS. 5 and 11, the gate door (40) must also be lifted up to release the locking bolt (43) at the bottom of the gate door (40) from the locking bolt hole (121) in the frame (10) when the release button (54) is pressed down. The coordinated actions required to open the gate door (40) are relatively easy for an adult, are difficult for a child and are virtually impossible for a pet.

Even though numerous characteristics and advantages of the present invention have been set forth in the foregoing description together with details of the structure and function of the invention, the disclosure is illustrative only. Changes may be made in detail especially in matters of shape, size, and arrangement of parts within the principles of the invention to the full extent indicated by the broad general meaning of the terms in which the appended claims are expressed.

What is claimed is:

1. A gate comprises a frame having four outer corners, each outer corner having a threaded hole;

an opening formed in the frame and having a bottom edge;

a pivot hole formed in the bottom edge of the opening; and a locking plate mounted on the bottom edge of the opening and having a locking bolt hole formed in the locking plate;

a top inner proximal corner; and a top inner distal corner;

a hinge pin seat attached to the top inner proximal corner of the frame and having a barrel formed in the hinge pin seat and having an inclined inner end;

a latch seat attached to the top inner distal corner of the frame and having two side surfaces;
a latch pin recess formed horizontally in the latch seat;
a latch bolt recess formed horizontally in the latch seat; and
two inclined notches formed respectively on side surfaces of the latch seat and communicating with the latch pin recess;
a gate door having
a top proximal corner;
a top distal corner;
a bottom;
a bottom pivot pin protruding down from the bottom of the gate door and mounted pivotally and slidably in the pivot hole of the frame;
a top pivot pin attached to the top proximal corner of the gate door, having an inclined bottom surface and rotatably mounted in the barrel in the hinge pin seat;
a locking bolt seat mounted on the bottom of the gate door;
a spring mounted in the locking bolt seat; and
a locking bolt mounted in the locking bolt seat and held in the locking bolt hole of the frame;
a latch attached to the top distal corner of the gate door and having
a front casing having
a top;
a front surface;
a front end;
a button recess formed in the top of the front casing;
a latch pin cutout formed in front end of the front casing;
a latch bolt cutout formed in front end of the front casing; and
a through hole formed through the front surface of the front casing;
a rear casing attached to the front casing and having
a top;
a rear surface;
a front end;
a button recess formed in top of the rear casing and mating with the button recess of the front casing to form a button hole;
a latch pin recess formed horizontally inside the rear casing;
a latch bolt recess formed horizontally inside the rear casing;
a latch pin cutout formed in the front end of the rear casing, communicating with the latch pin recess of the rear casing and mating with the latch pin cutout in the front casing to form a latch pin hole; and
a latch bolt cutout formed in the front end of the rear casing, communicating with the latch bolt recess the rear casing and mating with the latch bolt cutout in the front casing to form a latch bolt hole;
a latch block mounted slidably in the latch block recess in the rear casing and having
a distal end;
a side;
a latch bolt formed on and protruding from the distal end of the latch block, extending through the latch bolt hole in the latch and engaging the latch bolt recess of the latch seat;
an eccentric hole formed through the side of the latch block; and
a spring mounted between the latch block and the rear casing and having
a front end pressing against the side of the rear casing; and
a rear end pressing against the latch block;
a latch pin mounted in the latch pin recess in the rear casing and having
a front end protruding through the latch pin hole in the latch and engaging the latch pin recess in the latch seat;
a rear end; and
a spring mounted around the rear end of the latch pin and pressing against the rear end of the latch pin and the latch pin recess;
a knob having
an inside surface; and
an eccentric shaft formed on and protruding from the inside surface of the knob, extending through the through hole in the front casing, engaging the eccentric hole in the latch block and having an eccentric edge;
a release button mounted in the button hole in the latch and having
a bottom;
two actuating legs formed on and protruding down from the bottom of the release button in parallel on opposite sides of the latch pin and having an inclined edge that retracts the latch pin from the latch pin recess in the latch seat when the release button is pressed down; and
multiple springs pressing against the bottom of the release button; and
four mounting bolts mounted respectively in the threaded holes in the outer corners of the frame, and each mounting bolt having
a distal end;
a locking nut having a threaded central hole;
a threaded shaft screwing through the locking nut and into the threaded hole in a corresponding outer corner of the frame; and
a head formed on the distal end of the mounting bolt.

2. The gate as claimed in claim 1, wherein
the frame further has a locking plate mounted on the bottom of the frame; and
the locking bolt hole is formed in the locking plate.

* * * * *